US012618636B2

(12) United States Patent
McPherson et al.

(10) Patent No.: US 12,618,636 B2
(45) Date of Patent: May 5, 2026

(54) ARCHERY BOW STABILIZER

(71) Applicant: Mathews Archery, Inc., Sparta, WI (US)

(72) Inventors: Mathew A. McPherson, Norwalk, WI (US); John R. Scovil, Scottsdale, AZ (US); Mark J. Hayes, Onalaska, WI (US)

(73) Assignee: Mathews Archery, Inc., Sparta, WI (US)

( * ) Notice: Subject to any disclaimer, the term of this patent is extended or adjusted under 35 U.S.C. 154(b) by 161 days.

(21) Appl. No.: 18/510,512

(22) Filed: Nov. 15, 2023

(65) Prior Publication Data

US 2024/0159490 A1 May 16, 2024

Related U.S. Application Data

(60) Provisional application No. 63/425,642, filed on Nov. 15, 2022.

(51) Int. Cl.
*F41B 5/14* (2006.01)

(52) U.S. Cl.
CPC ..... *F41B 5/1426* (2013.01)

(58) Field of Classification Search
CPC ..... F41B 5/1426; A63B 21/072
USPC ..... 124/86, 89; 482/92, 93, 148
See application file for complete search history.

(56) References Cited

U.S. PATENT DOCUMENTS

| | | | | |
|---|---|---|---|---|
| 1,010,051 | A | 11/1911 | Hoffman | |
| 3,670,712 | A | 6/1972 | Izuta | |
| 4,076,236 | A * | 2/1978 | Ionel | A63B 21/0728 482/106 |
| 4,566,690 | A * | 1/1986 | Schook | A63B 21/0728 482/106 |
| 4,570,608 | A * | 2/1986 | Masterfield | F41B 5/1426 188/378 |
| 4,615,327 | A * | 10/1986 | Saunders | F41B 5/1426 124/89 |
| 4,955,356 | A * | 9/1990 | Pike | F41B 5/1426 124/88 |
| 5,273,022 | A * | 12/1993 | Leven | F41B 5/1426 124/88 |
| 5,464,379 | A * | 11/1995 | Zarecky | A63B 21/0728 482/106 |
| D415,812 | S | 10/1999 | Andrews, Jr. et al. | |
| 5,975,070 | A | 11/1999 | Sands | |
| 6,718,964 | B1 | 4/2004 | Graf | |
| 6,802,307 | B2 | 10/2004 | Leven | |
| 7,318,430 | B2 | 1/2008 | Leven | |
| 7,832,109 | B2 | 11/2010 | Gibbs | |
| 7,958,881 | B2 | 6/2011 | Silverson | |
| 7,997,258 | B2 | 8/2011 | Shepley et al. | |
| 8,166,963 | B2 | 5/2012 | Leven | |
| 8,418,683 | B2 | 4/2013 | Leven | |
| D682,969 | S | 5/2013 | Khoshnood et al. | |
| D682,970 | S | 5/2013 | Khoshnood et al. | |
| D682,971 | S | 5/2013 | Khoshnood et al. | |

(Continued)

*Primary Examiner* — John E Simms, Jr.
(74) *Attorney, Agent, or Firm* — Laabs Intellectual Property

(57) ABSTRACT

In some embodiments, an archery stabilizer comprises a bar arranged to engage an archery bow. A mount is supported by the bar. The mount comprises a receptacle. A weight is supported by the mount. The weight comprises a coupler engaged with the receptacle.

18 Claims, 9 Drawing Sheets

(56) References Cited

U.S. PATENT DOCUMENTS

| | | | |
|---|---|---|---|
| D685,874 | S | 7/2013 | Andrews, Jr. et al. |
| D691,232 | S | 10/2013 | Khoshnood et al. |
| 8,573,193 | B2 | 11/2013 | Khoshnood |
| 8,590,522 | B2 | 11/2013 | Khoshnood et al. |
| 8,833,356 | B2 | 9/2014 | Khoshnood |
| 8,839,525 | B2 | 9/2014 | Pulkrabek et al. |
| D718,404 | S | 11/2014 | Barnett |
| 9,016,268 | B2 | 4/2015 | Leven |
| 9,038,617 | B1 | 5/2015 | Khoshnood et al. |
| D735,830 | S | 8/2015 | Khoshnood |
| 9,097,491 | B2 | 8/2015 | Summers et al. |
| 9,383,158 | B1 | 7/2016 | Khoshnood |
| 9,500,433 | B2 | 11/2016 | McPherson |
| D775,298 | S | 12/2016 | Barnett |
| D775,705 | S | 1/2017 | Khoshnood et al. |
| D779,617 | S | 2/2017 | Barnett |
| D779,621 | S | 2/2017 | Salvador |
| D780,277 | S | 2/2017 | Barnett |
| 9,612,087 | B2 | 4/2017 | Summers et al. |
| 9,658,025 | B2 | 5/2017 | Trpkovski |
| D791,898 | S | 7/2017 | Khoshnood et al. |
| 9,829,269 | B2 | 11/2017 | McPherson |
| D834,113 | S | 11/2018 | Chu |
| D863,480 | S | 10/2019 | Miao |
| D868,194 | S | 11/2019 | Ozanne |
| D868,195 | S | 11/2019 | Ozanne |
| D884,818 | S | 5/2020 | Hayes |
| 10,655,927 | B2 | 5/2020 | Simonds et al. |
| 10,816,304 | B2 | 10/2020 | McPherson et al. |
| D1,052,033 | S * | 11/2024 | Scovil ..... D22/107 |
| 2011/0120440 | A1 | 5/2011 | Stokes |
| 2013/0118468 | A1 | 5/2013 | Kozlik et al. |
| 2014/0069402 | A1 | 3/2014 | McPherson |
| 2014/0069404 | A1 | 3/2014 | McPherson |
| 2015/0233664 | A1 | 8/2015 | McPherson |
| 2019/0323258 | A1 | 10/2019 | Ma |
| 2023/0321474 | A1 * | 10/2023 | Nalley ..... A63B 21/4035 482/107 |

* cited by examiner

ARCHERY BOW STABILIZER

CROSS-REFERENCE TO RELATED APPLICATIONS

This application claims the benefit of U.S. Patent Application No. 63/425,642, filed Nov. 15, 2022, the entire content of which is hereby incorporated herein by reference.

BACKGROUND OF THE INVENTION

This invention relates to archery bow stabilizers, which are generally known in the art. Although it is desirable for an archery bow to be lightweight, it is also desirable for a bow to be stable. Stabilizers are often used to add mass to a bow using weights that are spaced apart from the bow. It is common for archers to adjust the amount of weight and/or the location of a weight in a stabilizer according to personal preference.

Adjusting weights in a stabilizer can be difficult or inconvenient. There remains a need for novel archery bow stabilizer designs that allow for fast and easy addition or subtraction of weight.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery stabilizer comprises a bar arranged to engage an archery bow. A mount is supported by the bar. The mount comprises a receptacle. A weight is supported by the mount. The weight comprises a coupler engaged with the receptacle.

In some embodiments, the receptacle comprises a receptacle cavity. The coupler comprises a coupler protrusion oriented in the receptacle cavity. In some embodiments, the coupler comprises a coupler cavity. The receptacle comprises a receptacle protrusion oriented in the coupler cavity. In some embodiments, a surface of the receptacle protrusion comprises a wall of the receptacle cavity. In some embodiments, the receptacle comprises diverging surfaces that define the receptacle cavity.

In some embodiments, the receptacle comprises receptacle diverging surfaces and the coupler comprises coupler diverging surfaces arranged to contact the receptacle diverging surfaces.

In some embodiments, the mount further comprises a seat and the weight comprises a plug contacting the seat.

In some embodiments, a weight comprises a weight receptacle. A second weight comprises a second coupler, which is engaged with the weight receptacle. In some embodiments, the weights comprise similar shapes.

In some embodiments, a locking member is engaged with the weight. The locking member comprises a body and a locking plug moveable with respect to the body. The locking plug is arranged to apply a force to the weight.

In some embodiments, an archery stabilizer comprises a bar arranged to engage an archery bow and a mount attached to the bar by a fastener. The mount comprises a mount receptacle. A first weight comprises a coupler that is engaged with the mount receptacle. The first weight does not contact the fastener.

In some embodiments, a second weight is attached to the first weight, wherein the second weight does not contact the fastener.

In some embodiments, the first weight comprises a weight receptacle and the second weight comprises a second coupler engaged with the weight receptacle.

In some embodiments, an archery stabilizer comprises a bar arranged to engage an archery bow. A mount is supported by the bar. The mount comprises a seat. A locking member is supported by the mount. The locking member comprises a body and a locking plug moveable with respect to the body. The locking plug is arranged to apply a force to the seat.

In some embodiments, the archery stabilizer further comprises a weight supported by the mount, the locking member supported by the weight.

In some embodiments, the locking plug is arranged to contact the seat.

In some embodiments, the locking member comprises a fastener engaged with the body and arranged to move the locking plug with respect to the body. In some embodiments, the fastener is arranged to bias the body away from the mount.

In some embodiments, the mount comprises a receptacle and the locking member comprises a coupler arranged to engage the receptacle.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
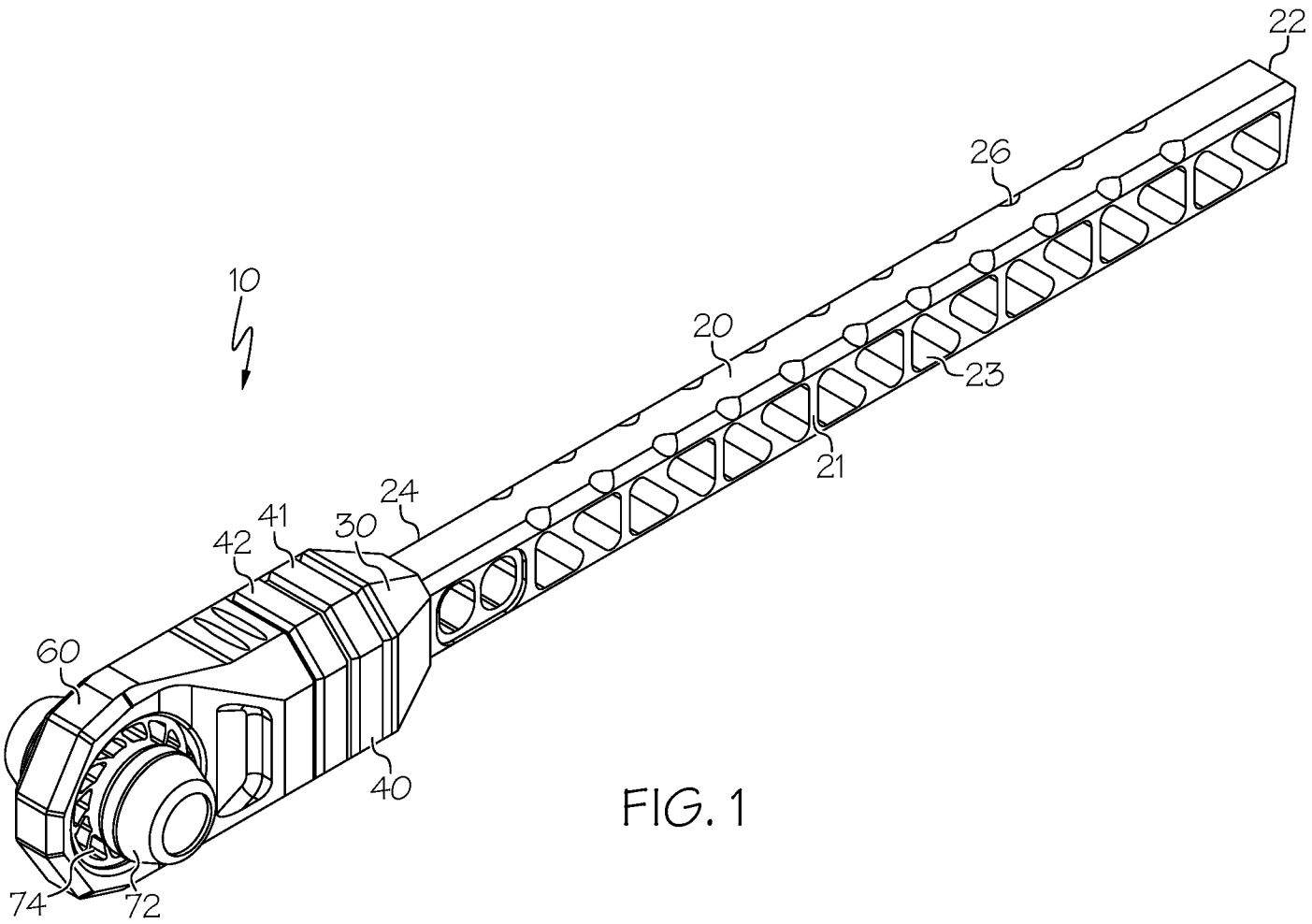
FIGS. 1 and 2 show views of an embodiment of an archery stabilizer.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
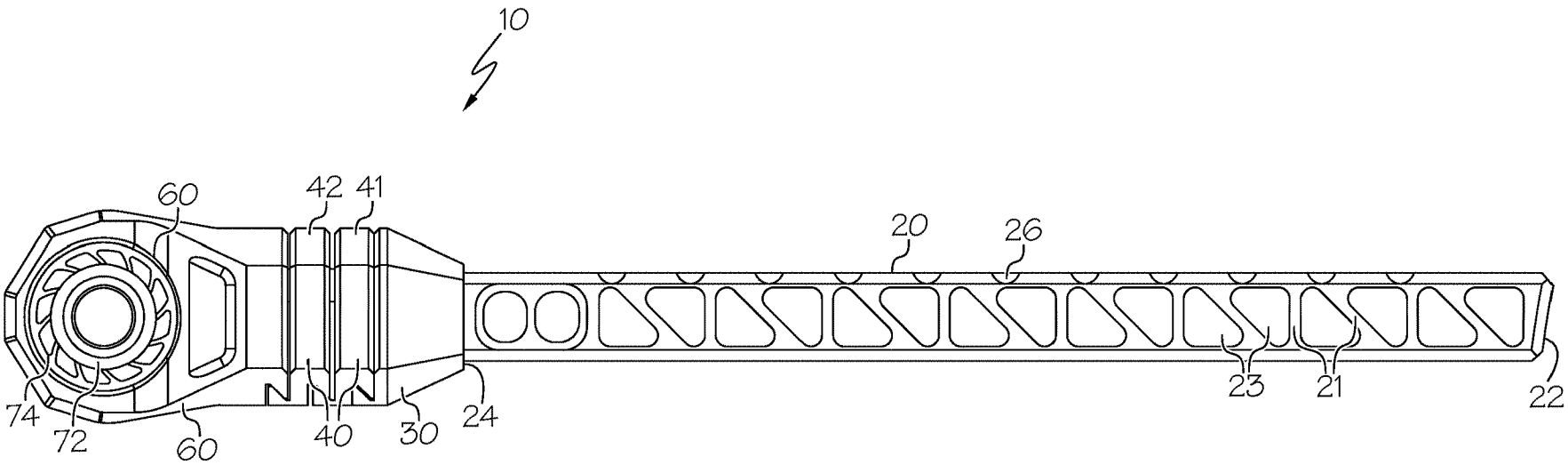

FIGS. 1 and 2 show views an embodiment of an archery bow stabilizer 10. In some embodiments, a stabilizer 10 comprises a bar 20, a mount 30, at least one weight 40 and a locking member 60.

In some embodiments, a bar 20 comprises a structural member arranged to be supported, for example by an archery bow near a first end 22 of the bar 20. In some embodiments, a bar 20 comprises a pattern of structural members 21 and cavities 23. In some embodiments, the bar 20 comprises a plurality of detents 26 spaced along the length of the bar 20. In some embodiments, a detent 26 comprises a cavity.

In some embodiments, a second end 24 of the bar 20 is arranged to support a weight 40. In some embodiments, the bar 20 supports a mount 30 and the mount 30 is arranged to support the weight 40. In some embodiments, a plurality of weights 40 are used.

In some embodiments, the mount 30 supports a first weight 41 and the first weight 41 supports a second weight 42. In some embodiments, the second weight 42 does not contact the mount 30. In some embodiments, a third weight (not illustrated) is supported by the second weight 42. In some embodiments, a plurality of weights 40 are arranged to be supported sequentially, wherein each successive weight is supported by the previous weight and any suitable number of weights can be used.

In some embodiments, a locking member 60 is supported by the last weight 40, for example the weight 40 most distal from the bar 20. In some embodiments, a locking member 60 comprises a vibration damper comprising a suspended weight 72 and a resilient member 74.

Figure 3:
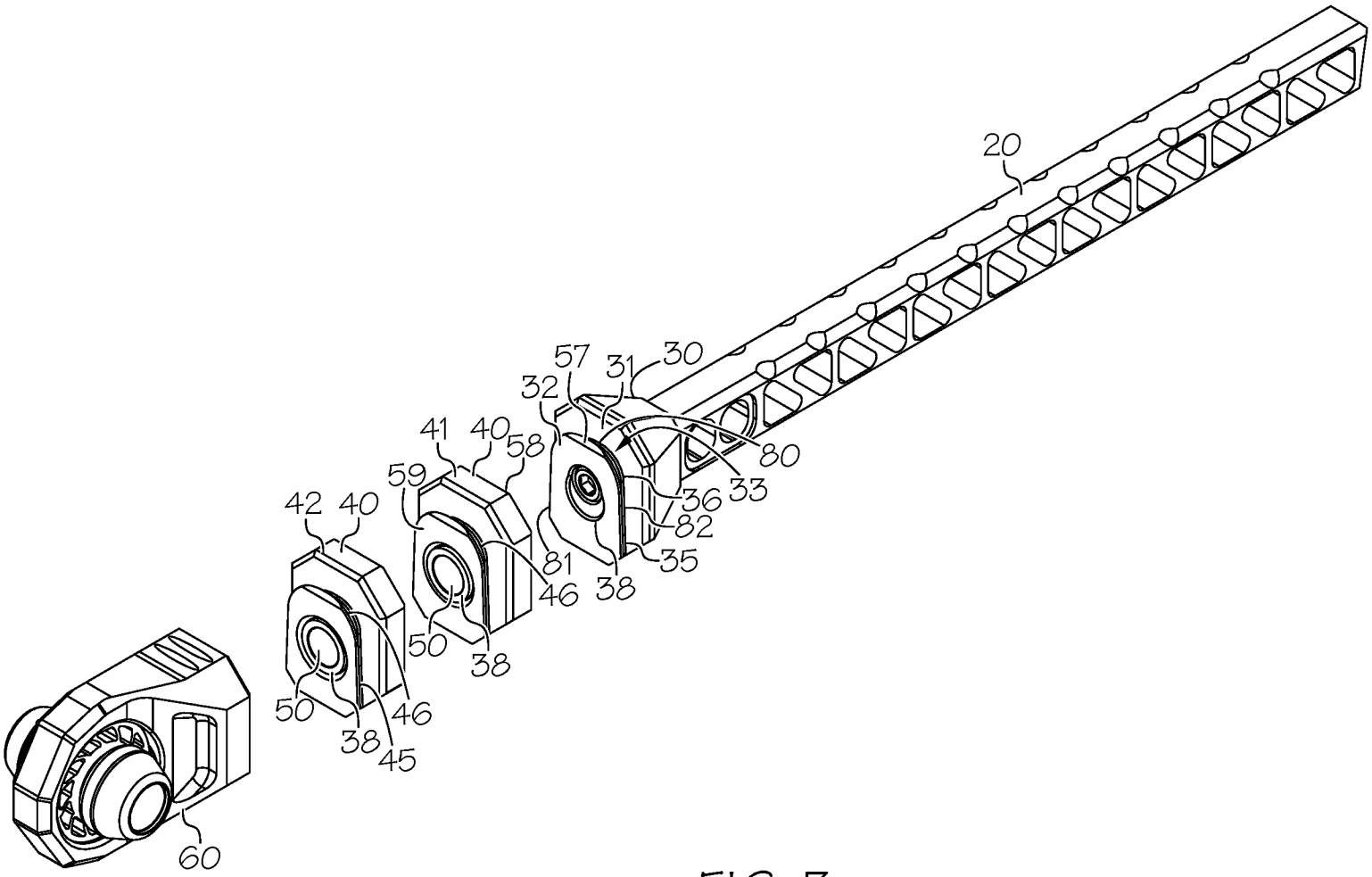
FIGS. 3 and 4 show views of an embodiment of a stabilizer with components disassembled.
Figure 4:
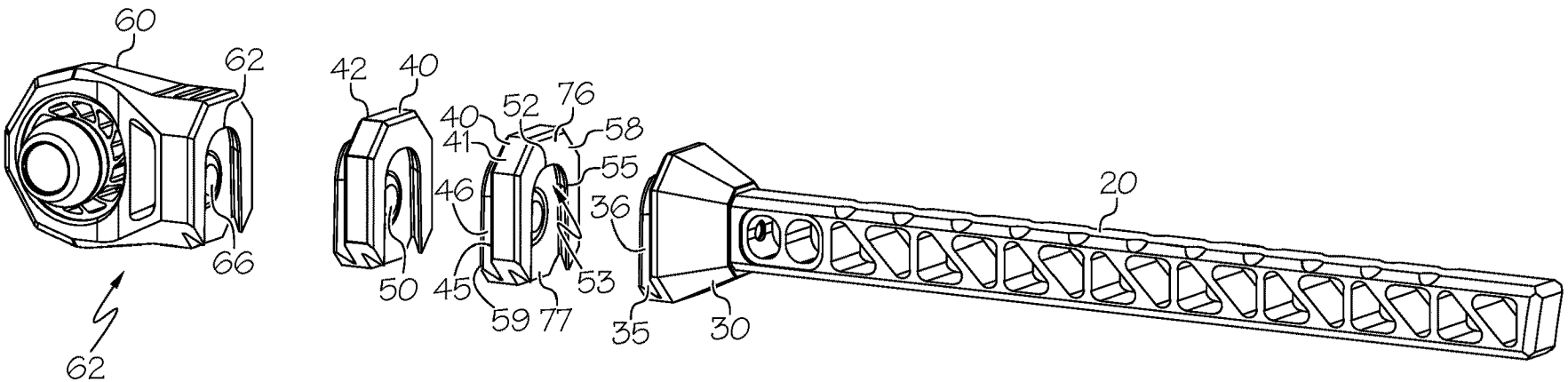
Figure 5A:
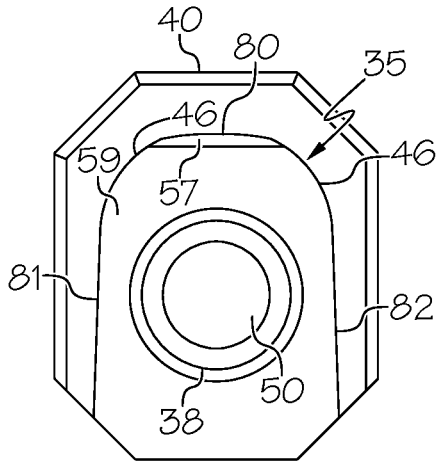
FIG. 5 shows front and back views of an embodiment of a weight.
Figure 5B:
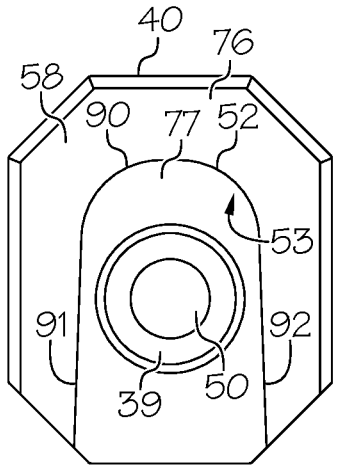

FIGS. 3 and 4 show views of an embodiment of a stabilizer 10 with components disengaged from one another. FIG. 5 shows front and back views of an embodiment of a weight 40.

In some embodiments, a bar 20 supports a mount 30. In some embodiments, the mount 30 comprises a receptacle 36. Desirably, the receptacle 36 is constructed and arranged to engage a weight 40. In some embodiments, the mount 30 supports the weight 40 and the weight 40 does not contact the bar 20.

In some embodiments, a weight 40 comprises a coupler 52. Desirably, a coupler 52 is constructed and arranged to engage a receptacle 36. In some embodiments, a receptacle 36 defines a cavity 33 located between a first surface 31 and a second surface 32 of the mount 30. In some embodiments, the first surface is 31 parallel to the second surface 32. In some embodiments, the second surface 32 protrudes outward from the first surface 31 and the receptacle 36 comprises a shelf arranged to support a weight 40. In some embodiments, the cavity 33 is contoured and comprises curvature along its length. In some embodiments, a longitudinal axis of the contoured cavity 33 extends in a u-shape. In some embodiments, at least a portion of a coupler 52 is oriented in the contoured cavity 33 when the coupler 52 is engaged with the receptacle 36.

In various embodiments, a receptacle 36 can have any suitable shape. In some embodiments, a receptacle 36 comprises a central portion 80, a first side 81 and a second side 82. In some embodiments, the central portion 80 comprises curvature. In some embodiments, the first side 81 is straight and the second side 82 is straight. In some embodiments, the first side 81 is parallel to the second side 82. In some embodiments, the first side 81 and second side 82 are oriented at an angle to one another. In some embodiments, the angle ranges from 4 degrees to 12 degrees. In some embodiments, the first side 81 diverges from the second side 82 when moving away from the central portion 80.

In some embodiments, the receptacle 36 comprises a reverse bevel 35 that undercuts the second surface 32 and forms the contoured cavity 33. In some embodiments, the reverse bevel 35 extends continuously across the first side 81, the central portion 80 and the second side 81 of the receptacle 36, for example extending in a U-shape. In some embodiments, a distance between the first side 81 and the second side 82 of the receptacle 36 (e.g. on the second surface 32) is greater than a distance between a first side and a second side of the contoured cavity 33 (e.g. behind the second surface 32). In some embodiments, a receptacle 36 comprises diverging surfaces. In some embodiments, the diverging surfaces extend away from one another as the receptacle 36 is traversed in a direction away from the bar 20.

In some embodiments, a coupler 52 is constructed and arranged to matingly engage a receptacle 36. In some embodiments, the coupler 52 comprises a cavity 53 located between a first surface 76 and a second surface 77 of the weight 40. In some embodiments, the first surface is 76 parallel to the second surface 77. In some embodiments, the second surface 77 is recessed behind the first surface 76 and the coupler 52 comprises a protrusion arranged to engage a receptacle 36. In some embodiments, the cavity 53 is contoured and comprises curvature along its length. In some embodiments, a longitudinal axis of the contoured cavity 53 extends in a u-shape. In some embodiments, at least a portion of a receptacle 36 is oriented in the contoured cavity 53 when the coupler 52 is engaged with the receptacle 36.

In various embodiments, a coupler 52 can have any suitable shape. In some embodiments, a coupler 52 comprises a central portion 90, a first side 91 and a second side 92. In some embodiments, the central portion 90 comprises curvature. In some embodiments, the first side 91 is straight and the second side 92 is straight. In some embodiments, the first side 91 is parallel to the second side 92. In some embodiments, the first side 91 and second side 92 are oriented at an angle to one another. In some embodiments, the angle ranges from 4 degrees to 12 degrees. In some embodiments, the first side 91 diverges from the second side 92 when moving away from the central portion 90.

In some embodiments, the coupler 52 comprises a reverse bevel 55 that undercuts the first surface 76 and forms the contoured cavity 53. In some embodiments, the reverse bevel 55 extends continuously across the first side 91, the central portion 90 and the second side 91 of the coupler 52, for example extending in a U-shape. In some embodiments, a distance between the first side 91 and the second side 92 of the coupler (e.g. on the first surface 76) is less than a distance between a first side and a second side of the contoured cavity 53 (e.g. behind the first surface 76).). In some embodiments, a coupler 52 comprises diverging surfaces. In some embodiments, the diverging surfaces extend away from one another as the coupler 52 is traversed in a direction away from the bar 20.

In some embodiments, a portion of the coupler 52 is oriented in the contoured cavity 33 of the receptacle 36 and a portion of the receptacle 36 is oriented in the contoured cavity 53 of the coupler 52 when the coupler 52 is engaged with the receptacle 36. In some embodiments, the first surface 31 of the receptacle 36 is directly adjacent to the first surface 76 of the coupler 52 and the second surface 32 of the receptacle 36 is directly adjacent to the second surface 77 of the coupler when the coupler 52 is engaged with the receptacle 36. In some embodiments, the reverse bevel of the receptacle 36 contacts the reverse bevel 55 of the coupler 52 when the coupler 52 is engaged with the receptacle 36.

In some embodiments, a weight 40 comprises a receptacle 46 constructed and arranged to engage a coupler 52. In some embodiments, the receptacle 46 provided on a weight 40 comprises features as described with respect to the receptacle 36 of the mount 30. In some embodiments, a receptacle 46 comprises a reverse bevel 45. In some embodiments, a weight 40 comprises a first side 58 comprising a coupler 52 and a second side 59 comprising a receptacle 46. Thus, a mount 30 can support a first weight 41, the first weight 41 can support a second weight 42, etc. In some embodiments, any suitable number of weights 40 can be used. In some embodiments, the first weight 41 is generally similar to the second weight 42. In some embodiments, a stabilizer 10 comprises several weights 40, with each weight 40 supporting a successive weight 40.

In some embodiments, a stabilizer 10 comprises a locking member 60. In some embodiments, a locking member 60 comprises a locking mechanism 64 arranged to stress certain components of the stabilizer 10, for example to lock the weights 40 and mount 30 to one another.

In some embodiments, the locking member 60 comprises a distal end unit of the stabilizer 10. In some embodiments, the locking member 60 is constructed and arranged to engage a weight 40 and to be supported by the weight 40. In some embodiments, the locking member 60 comprises a coupler 62 arranged to engage a receptacle 36, 46. In some embodiments, the coupler 62 provided on a locking member 60 comprises features as described with respect to the coupler 52 of the weight 40.

Figure 6:
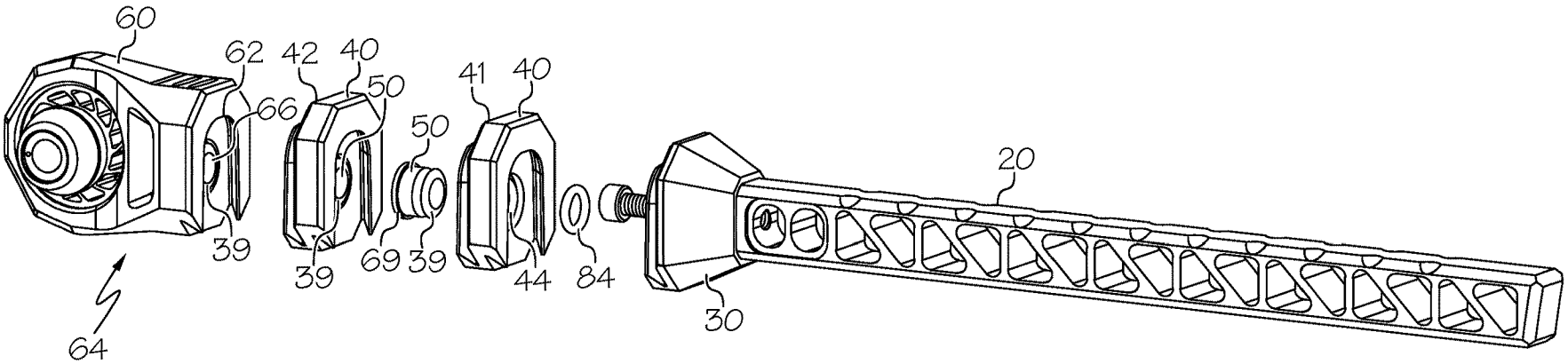
FIGS. 6 and 7 show views of an embodiment of a stabilizer with some components exploded.
Figure 7:
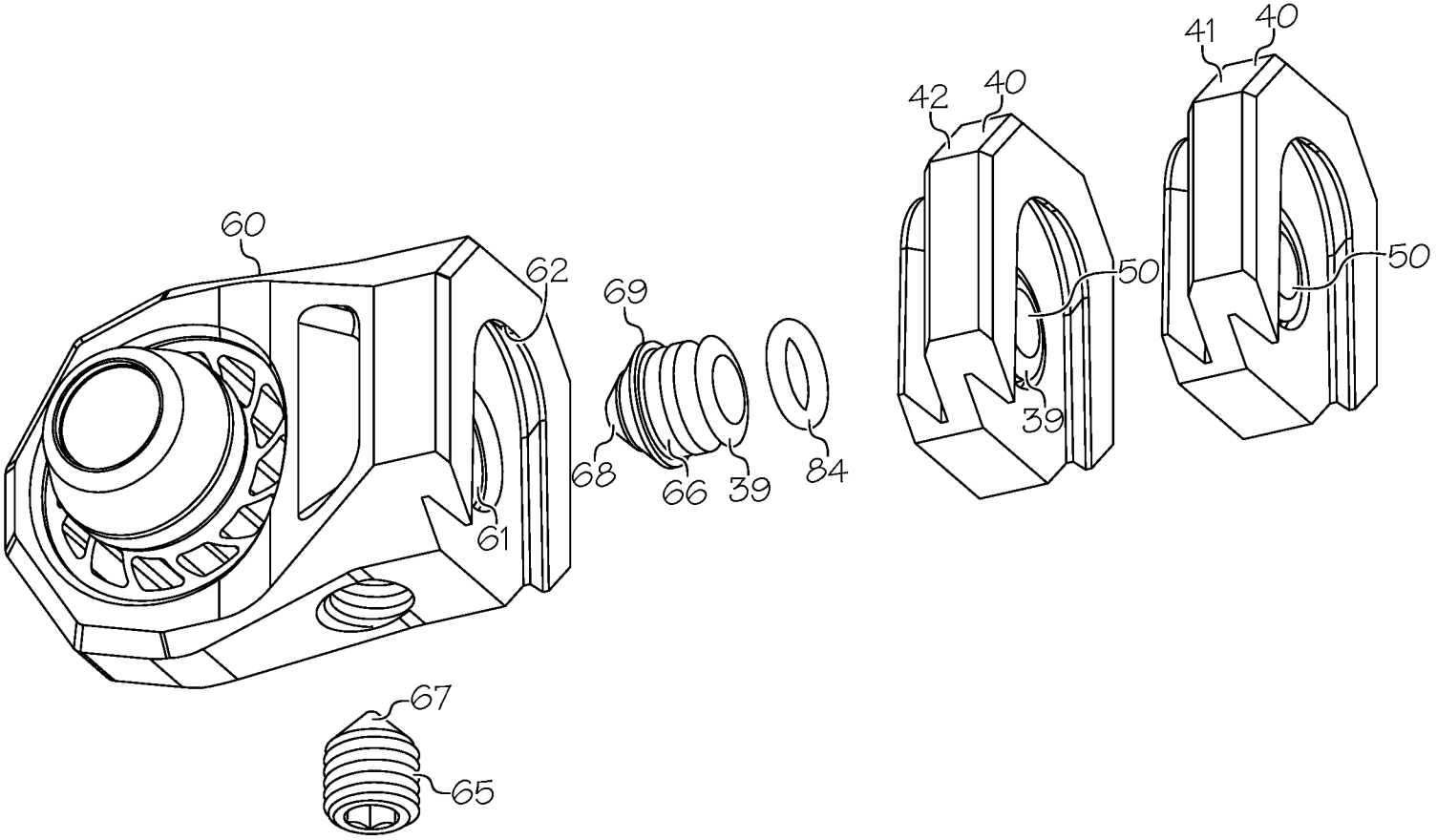

FIGS. 6 and 7 show exploded views of an embodiment of a stabilizer 10. In some embodiments, a locking mechanism 64 comprises a fastener, such as a locking screw 65. In some embodiments, a locking screw 65 engages a threaded cavity provided in the locking member 60. In some embodiments, a locking screw 65 comprises a bevel 67 arranged to wedge against another portion of the stabilizer 10, for example against another portion of the locking member 60 or against a weight 40. In some embodiments, the locking member 60 comprises a locking plug 66. In some embodiments, a body of the locking member 60 comprises a cavity 61 and the locking plug 66 is received in the cavity 61. In some embodiments, the locking plug 66 is arranged for movement with respect to the body of the locking member 60. In some embodiments, the locking plug 66 is arranged to contact a weight 40.

In some embodiments, a locking plug 66 comprises a bevel surface 68 arranged to contact a bevel 67 of the locking screw 65. In some embodiments, tightening the locking screw 65 will move the locking plug 66 with respect to the body of the locking member 60. In some embodiments, the locking plug 66 comprises a flange 69 arranged to retain the locking plug 66 in the cavity 61. In some embodiments, a locking plug 66 comprises a retainer 84 arranged to retain the locking plug in the cavity 61. In some embodiments, a retainer 84 comprises an o-ring. In some embodiments, a retainer 84 comprises a polymeric or elastomeric material that is more flexible than material used for the locking member 60. In some embodiments, the retainer 84 limits movement of the locking plug 66 with respect to the locking member 60 but allows movement sufficient for tightening of the locking mechanism 64.

In some embodiments, a weight 40 comprises a body member comprising a cavity 44 and a plug 50 oriented in the cavity 44. In some embodiments, the plug 50 is moveable with respect to the body of the weight 40. In some embodiments, a plug 50 comprises a retainer 84 arranged to retain the plug 50 in the cavity 44. In some embodiments, a retainer 84 comprises an o-ring. In some embodiments, a retainer 84 comprises a polymeric or elastomeric material that is more flexible than material used for the body of the weight 40. In some embodiments, the retainer 84 limits movement of the plug 50 with respect to the weight 40 body but allows movement sufficient for tightening of the locking mechanism 64.

In some embodiments, the locking plug 66 of the locking mechanism 60 contacts the plug 50 of an adjacent weight 40. For example, in some embodiments, the locking plug 66 contacts the plug 50 of a second weight 42. In some embodiments, the plug 50 of one weight contacts the plug 50 of an adjacent weight. For example, the plug 50 of the second weight 42 contacts the plug 50 of the first weight 40. In some embodiments, the plug 50 of the first weight 41 contacts the mount 30.

In some embodiments, the locking plug 66 of the locking mechanism 60 comprises a chamfer 39 and the plug 50 of a weight 40 comprises a seat 38. In some embodiments, the chamfer 39 is arranged to abut the seat 38. In some embodiments, the chamfer 39 and the seat 38 are circular and provide for self-centering of the locking plug 66 with the plug 50.

In some embodiments, a plug 50 comprises a seat 38 on one side and a chamfer 39 on the opposite side. In some embodiments, the seat 38 of a plug 50 of a first weight 41 is arranged to abut the chamfer 39 of a plug 50 of an adjacent weight 42. In some embodiments, the chamfer 39 of a plug 50 of a first weight 41 is arranged to abut a seat 38 provided on the mount 30 (see e.g. FIG. 3). Thus, in some embodiments, tightening a locking screw 65 of a locking member 60 will cause a locking plug 66 to compress against the plug 50 of an adjacent weight 40, 42, which will compress against the plug 50 of another adjacent weight 40, 41, and the plug 50 of a first weight 41 will compress against the mount 30.

Figure 8:
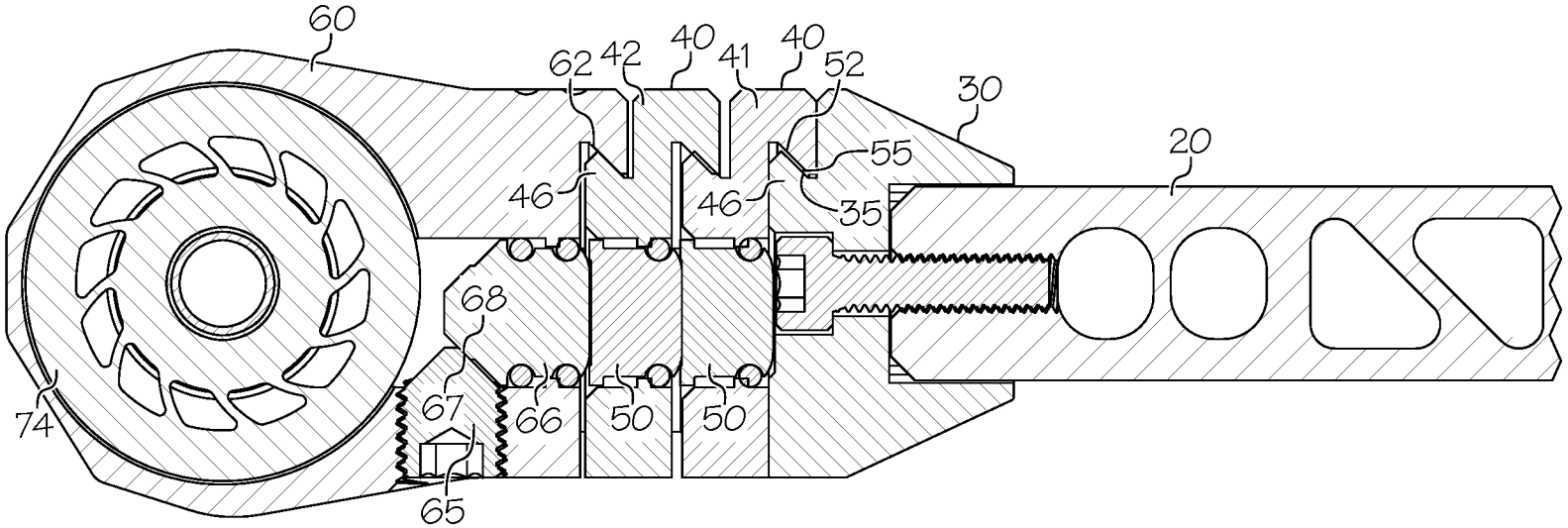
FIGS. 8 and 9 show cross-sectional views of an embodiment of a stabilizer.
Figure 9:
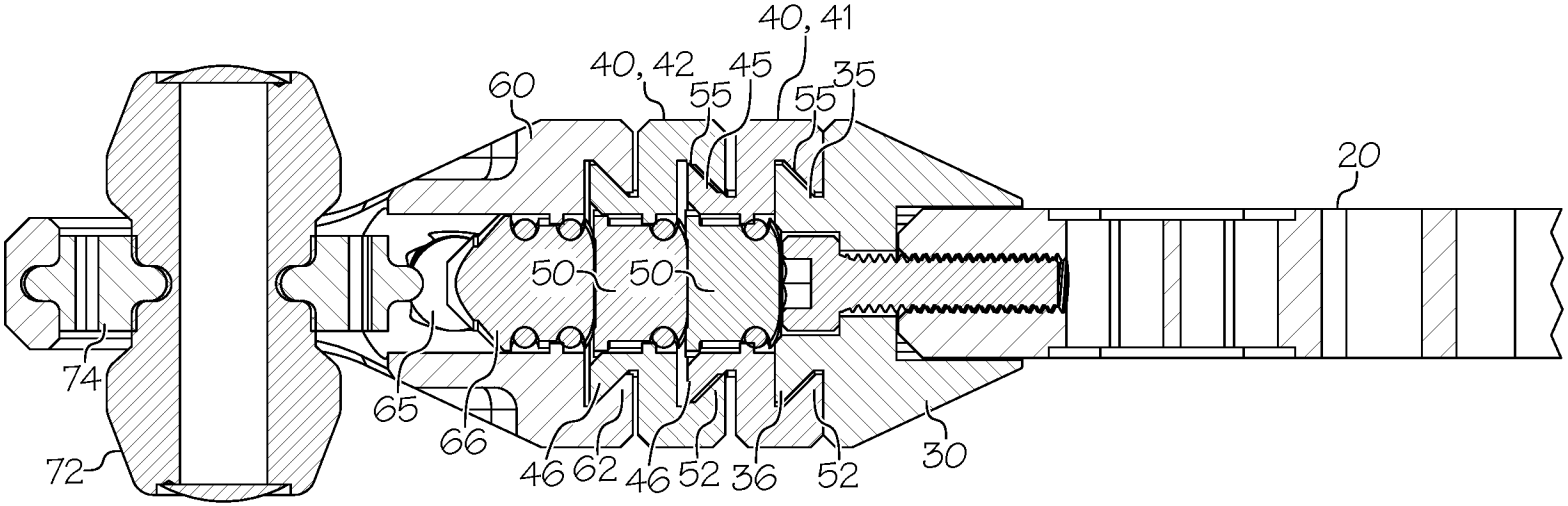

FIGS. 8 and 9 show cross-sectional views of an embodiment of a stabilizer 10. When the locking screw 65 of the locking member 60 is tightened, the locking plug 66 and the plugs 50 of the weights 40 compress against the mount 30. This works to move the locking member 60 away from the bar 20. The locking member 60 and weights 40 react in tension. The locking member 60 is biased away from the adjacent weight 42 but remains engaged via the coupler 62 engaging the receptacle 46 of the weight 42. The weight 42 is then tensioned away from the next adjacent weight 41 but remains engaged via its coupler 52 engaging the receptacle 46 of that weight 41. This action will continue successively through all the weights 40 used, which can vary. The first weight 41 is tensioned away from the mount 30 but remains engaged to the receptacle 36 of the mount 30. Thus, in some embodiments, a locking screw 65 places the locking plug 66 and the plugs 50 of the weights 40 into compression against the mount 30, while also placing the locking member 60 and weights 40 into tension.

In some embodiments, a stabilizer 10 comprises a mount 30 arranged to support a first weight, the first weight 41 arranged to support a second weight 42. In some embodiments, the first weight 41 and the second weight 42 overlap along a length of the device.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery stabilizer comprising:

a bar arranged to engage an archery bow;

a mount supported by the bar, the mount comprising a receptacle;

a weight supported by the mount, the weight comprising a seat and a coupler engaged with the receptacle; and a locking member supported by the weight, the locking member comprising a body, a locking plug moveable with respect to the body and a fastener arranged to move the locking plug with respect to the body, the locking plug arranged to apply a force to the seat.

2. The archery stabilizer of claim 1, the receptacle comprising a receptacle cavity, the coupler comprising a coupler protrusion oriented in the receptacle cavity.

3. The archery stabilizer of claim 2, the coupler comprising a coupler cavity, the receptacle comprising a receptacle protrusion, the receptacle protrusion oriented in the coupler cavity.

4. The archery stabilizer of claim 3, wherein a surface of the receptacle protrusion comprises a wall of the receptacle cavity.

5. The archery stabilizer of claim 3, the receptacle comprising diverging surfaces, the diverging surfaces defining the receptacle cavity.

6. The archery stabilizer of claim 1, the receptacle comprising receptacle diverging surfaces, the coupler comprising coupler diverging surfaces arranged to contact the receptacle diverging surfaces.

7. The archery stabilizer of claim 1, the seat comprising a weight seat, the mount further comprising a mount seat, the weight comprising a plug, the plug contacting the mount seat.

8. The archery stabilizer of claim 1, the weight being a first weight, the first weight comprising a weight receptacle, a second weight comprising a second coupler, the second coupler engaged with the weight receptacle.

9. The archery stabilizer of claim 8, the first weight and the second weight comprising similar shapes.

10. An archery stabilizer comprising:

a bar arranged to engage an archery bow;

a mount attached to the bar by a mounting fastener, the mount comprising a mount receptacle;

a first weight comprising a coupler, the coupler engaged with the mount receptacle; and a locking member supported by the first weight, the locking member comprising a body, a locking plug moveable with respect to the body and a locking fastener arranged to move the locking plug with respect to the body;

wherein the first weight does not contact the mounting fastener.

11. The archery stabilizer of claim 10, comprising a second weight attached to the first weight, the first weight supporting the second weight, the second weight supporting the locking member, wherein the second weight does not contact the mounting fastener.

12. The archery stabilizer of claim 11, the first weight comprising a weight receptacle, the second weight comprising a second coupler, the second coupler engaged with the weight receptacle.

13. The archery stabilizer of claim 12, the first weight and the second weight comprising similar shapes.

14. An archery stabilizer comprising:

a bar arranged to engage an archery bow;

a mount supported by the bar, the mount comprising a seat; and a locking member supported by the mount, the locking member comprising a body, a locking plug moveable with respect to the body and a fastener engaged with the body, the locking plug arranged to apply a force to the seat, the fastener arranged to move the locking plug with respect to the body.

15. The archery stabilizer of claim 14, further comprising a weight, the weight supported by the mount, the locking member supported by the weight.

16. The archery stabilizer of claim 14, the locking plug arranged to contact the seat.

17. The archery stabilizer of claim 16, the weight comprising a weight plug, the weight plug arranged to transmit a force from the locking plug to the seat.

18. The archery stabilizer of claim 14, the mount comprising a receptacle, the locking member comprising a coupler arranged to engage the receptacle.

* * * * *